US005157797A

United States Patent [19]

Forwick

[11] Patent Number: 5,157,797

[45] Date of Patent: Oct. 27, 1992

[54] BATHING AID

[76] Inventor: Robert Forwick, Balanstr. 39, D-8000 München 80, Fed. Rep. of Germany

[21] Appl. No.: 740,282

[22] Filed: Aug. 5, 1991

[30] Foreign Application Priority Data

Jul. 25, 1991 [DE] Fed. Rep. of Germany ..... 4124725

[51] Int. Cl.[5] ..... A47K 3/12

[52] U.S. Cl. ..... 4/566.1

[58] Field of Search ..... 4/560.1-566.1

[56] References Cited

U.S. PATENT DOCUMENTS

| | | | |
|---|---|---|---|
| 2,087,286 | 7/1937 | Hicks | 4/566.1 |
| 3,271,791 | 9/1966 | Sarff | 4/562.1 |
| 3,286,970 | 11/1966 | Nolan | 4/564.1 X |
| 4,624,019 | 11/1986 | Pennington-Richards | 4/566.1 |
| 5,103,509 | 4/1992 | Richards | 4/564.1 |

*Primary Examiner*—Charles E. Phillips

*Attorney, Agent, or Firm*—Herbert L. Lerner; Laurence A. Greenberg

[57] ABSTRACT

A bathing aid includes a basic frame to be inserted into a bathtub. The basic frame has a U-shaped bottom frame with legs and a rear crossbar between the legs. Two outer hydraulic cylinders protrude obliquely upward from the rear cross-bar and have upper ends. Inner hydraulic cylinders telescopically run into the outer hydraulic cylinders and have upper ends. A seat frame has a backrest with an upper edge being pivotably connected to the upper ends of the inner hydraulic cylinders. A reversible multi-position valve connects the hydraulic cylinders to a cold-water faucet of the bathtub for hydraulically raising and lowering the seat frame in the bathtub. Two cylindrical rings encompass the upper ends of the outer hydraulic cylinders with play. A hoop joins the cylindrical rings to one another. A centrally mounted, rearwardly projecting strut and a suction cup lock the cylindrical rings to an end wall of the bathtub.

9 Claims, 3 Drawing Sheets

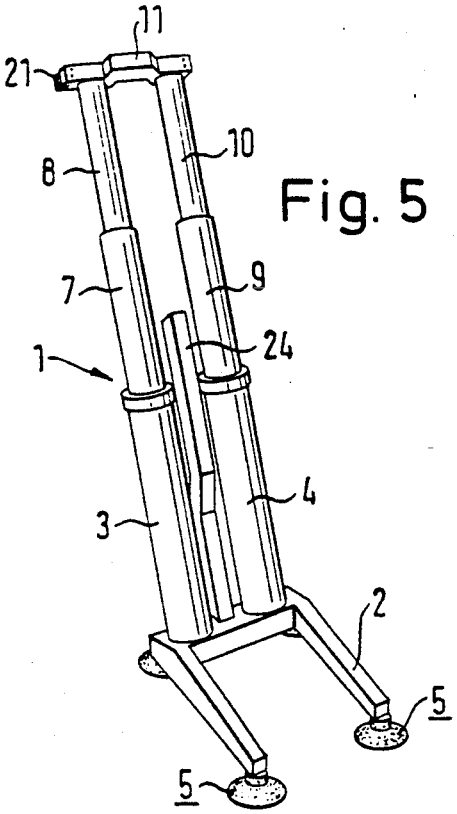
Fig. 5
Fig. 6
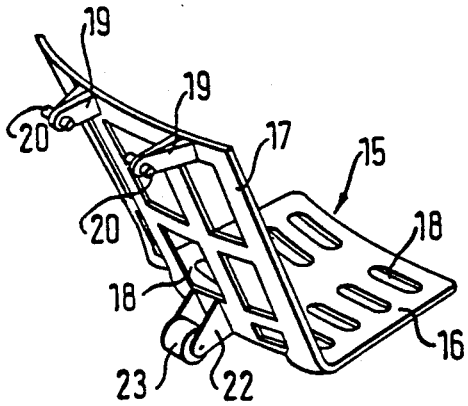
Fig. 7
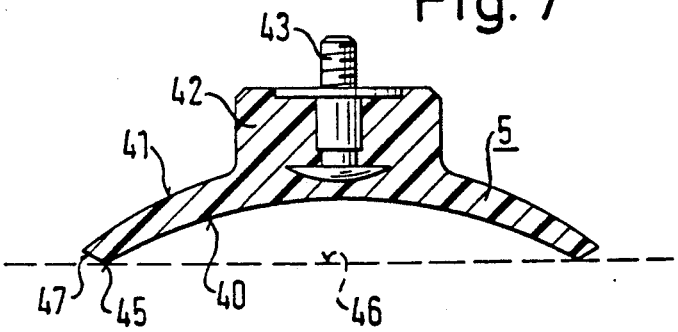
Fig. 8
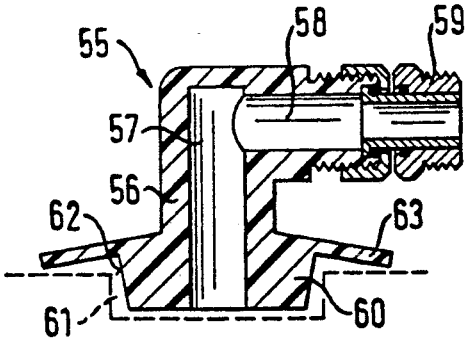

BATHING AID

The invention relates to a bathing aid including a seat that can be raised and lowered hydraulically in a bathtub, a basic frame that can be inserted into the bathtub and has a U-shaped bottom frame and two hydraulic cylinders protruding obliquely upward from a rear crossbar of the bottom frame and telescopically running into each other, the seat frame having an upper end being pivotably connected by the backrest to upper ends of the hydraulic cylinders, and the hydraulic cylinders being connected to a cold-water faucet of the bathtub through a reversible multi-position valve.

A bathing aid of the generic type described above is known from Published International Application WO 90/00891. However, the bathing aid described therein has a number of disadvantages. Among others, they are that the seat, which can be lowered to practically the bottom of the bathtub, presents the danger of allowing persons sitting on it to get their arms or legs caught between the side edge of the seat and the bathtub wall, which generally extends obliquely downward, if the persons move awkwardly. Moreover, problems arise in retaining the bathing aid in the bathtub, because although the suction cups that are provided, which are of a conventional type, do provide firm suction and thus a secure hold, they can only be released again from the underlying surface with difficulty and virtually only by using auxiliary tools. Another disadvantage is that the cold water draining out of the hydraulic cylinders mixes with the bathwater as it moves down the seat. With repeated reciprocation of the cylinders, this can cause a lowering of the temperature.

It is accordingly an object of the invention to provide a bathing aid, which overcomes the hereinafore-mentioned disadvantages of the heretofore-known devices of this general type, which substantially reduces the danger that body parts will catch on the seat and in which the seating aid can be released from its locked position as simply as possible.

With the foregoing and other objects in view there is provided, in accordance with the invention, a bathing aid, comprising a basic frame to be inserted into a bathtub, the basic frame having a U-shaped bottom frame with legs and a rear crossbar between the legs, two outer hydraulic cylinders protruding obliquely upward from the rear crossbar and having upper ends, inner hydraulic cylinders telescopically running into the outer hydraulic cylinders and having upper ends, a seat frame having a backrest with an upper edge being pivotably connected to the upper ends of the inner hydraulic cylinders, a reversible multi-position valve for connecting the hydraulic cylinders to a cold-water faucet of the bathtub for hydraulically raising and lowering the seat frame in the bathtub, two cylindrical rings encompassing the upper ends of the outer hydraulic cylinders with play, a hoop joining the cylindrical rings to one another, and a centrally mounted, rearwardly projecting strut and a suction cup locking the cylindrical rings to an end wall of the bathtub.

In accordance with another feature of the invention, the play between the rings and the outer hydraulic cylinders amounts to approximately 0.5 mm and enables a twisting capacity of the hydraulic cylinders.

As a result of this non-rigid retention of the outer hydraulic cylinders, it is possible for the hydraulic cylinders to twist slightly relative to their retaining means if a body part becomes caught between the side edge of the seat and the wall of the bathtub, so that the seat can thus deflect laterally, increasing the gap between the side edge of the seat and the inner wall of the tub, and thus reliably preventing body parts from becoming caught.

In accordance with a further feature of the invention, the seat frame includes a bowl and a seating surface being cast in one piece with the backrest and having apertures formed therein, the backrest being inclined to match the obliquely upward protrusion of the outer hydraulic cylinders, two vertical struts protruding from the upper edge of the backrest, and cross-pins inserted in the struts, and there is provided a crossbar joining the upper ends of the inner hydraulic cylinders, the crossbar having lateral grooves formed therein in which the cross-pins are pivotably suspended.

In accordance with an added feature of the invention, there is provided a guide rod disposed between the hydraulic cylinders, the guide rod having an upper region being bent parallel in a direction toward the backrest, and a rearwardly projecting slide roller disposed centrally on a bottom end of the backrest and sliding on the guide rod.

As a result of this bending of the guide rod at an angle, it is assured that when the seat is moved upward, it pivots outward somewhat toward the front, thus positioning the seating surface somewhat more steeply or in other words in such a way that it forms a small angle with the horizontal, which thus makes a better sitting position possible.

In accordance with an additional feature of the invention, there are provided concavely curved, circular platform-shaped suction cups for locking the bottom plate and the hoop holding the hydraulic cylinders against a wall of the bathtub, the suction cups having a contact surface and a rim extending radially outward past the contact surface and being inclined relative to a supporting plane by an angle of less than 90°.

Through the use of this rim that is inclined obliquely upward, the suction cups can be very easily pulled off of the surface to which the suction cups adhere by simply gripping this rim from behind, so that additional tools are not necessary.

In accordance with yet another feature of the invention, there is provided a shaped part to be inserted into a bathtub drain for draining hydraulic fluid, the shaped part including an angled tubular piece with two sides, a flexible drain line connected to one of the sides of the tubular piece from the hydraulic cylinders, and an annular extension on the other of the sides of the tubular piece facing toward the drain having a smaller outside diameter than the inside diameter of the bathtub drain for placement in the bathtub drain, the extension having a top changing into a radially projecting annular lip with a laterally protruding rim being wide enough to completely cover the bathtub drain.

Thus the cold hydraulic fluid can be drained out directly into the bathtub outlet, without having to mix with the bathwater.

In accordance with a concomitant feature of the invention, all of the parts coming into contact with the bathwater are coated with a bacteria-repellent lacquer or plastic.

Other features which are considered as characteristic for the invention are set forth in the appended claims.

Although the invention is illustrated and described herein as embodied in a bathing aid, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

FIG. 5 is a perspective view of a basic frame in the raised state;

FIG. 6 is a perspective view of a seating frame as seen from the rear;

FIG. 7 is a cross-sectional view of a suction cup; and

FIG. 8 is a cross-sectional view of a secondary outlet for hydraulic fluid.

Figure 1:
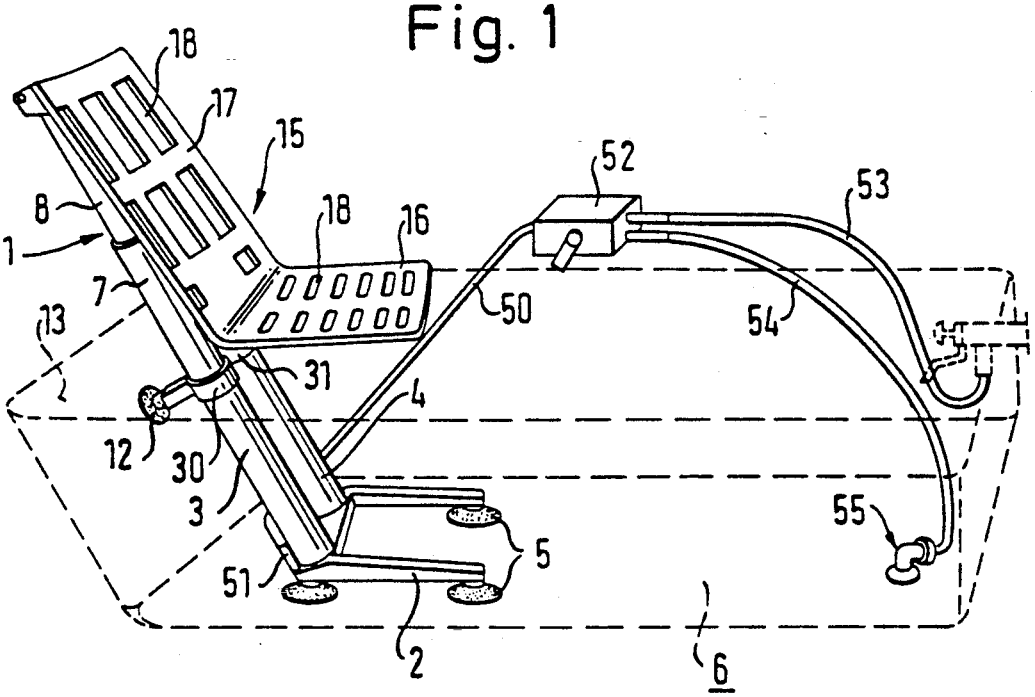
FIG. 1 is a diagrammatic, perspective view of a bathing aid in a raised state.

Referring now to the figures of the drawing in detail and first, particularly, to FIGS. 1 and 5 thereof, there is seen a bathing aid having a basic frame 1, which includes a U-shaped bottom frame 2 with legs and a rear crossbar between the legs, and two outer hydraulic cylinders or tubes 3, 4 protruding obliquely upward from the rear crossbar and having further cylinders or tubes that are movable within one another in telescoping fashion. The bottom frame 2 is held by respective suction cups 5 at each of its corners, to a bathtub 6 which is shown in broken lines. The suction cups will be separately described in further detail below.

The outer hydraulic cylinders or tubes 3 and 4 that are rigidly joined to the bottom plate 2 have two further or inner cylinders or tubes 7 and 8 being vertically movable within the cylinder 3 and two further or inner cylinders or tubes 9 and 10 being vertically movable within the cylinder 4. The cylinders 8 and 10 are upper cylinders which are joined together by a crossbar 11. A further suction cup 12 is provided on the back of the basic frame 1 in order to securely lock the frame in the bathtub 6. The inclination of the hydraulic cylinders 3 and 4 with respect to the bottom plate 2 is approximately equivalent to the inclination of a head end 13 of the bathtub 6, so that the disposition in the bathtub saves as much space as possible.

A seating frame 15 which is then secured to the base frame 1, includes a bowl that is cast in one piece, for instance of aluminum, having a seating surface 16 and a backrest 17 that is inclined to match the inclination of the hydraulic cylinders 3 and 4. Both the seating surface and the backrest have apertures 18.

As can be seen from the rear perspective view of FIG. 6, two rearwardly projecting struts 19 are provided on the backrest 17. Protruding from the struts 19 are cross-pins 20, which are suspended in lateral grooves 21 in the crossbar 11 of the upper hydraulic cylinders 8 and 10 as shown in FIG. 5. A slide roller 23 is also rotatably supported on a mounting 22 on the lower rear side of the backrest 17, so as to slide on a guide rod 24 disposed between the hydraulic cylinders 3 and 4.

Figure 2:
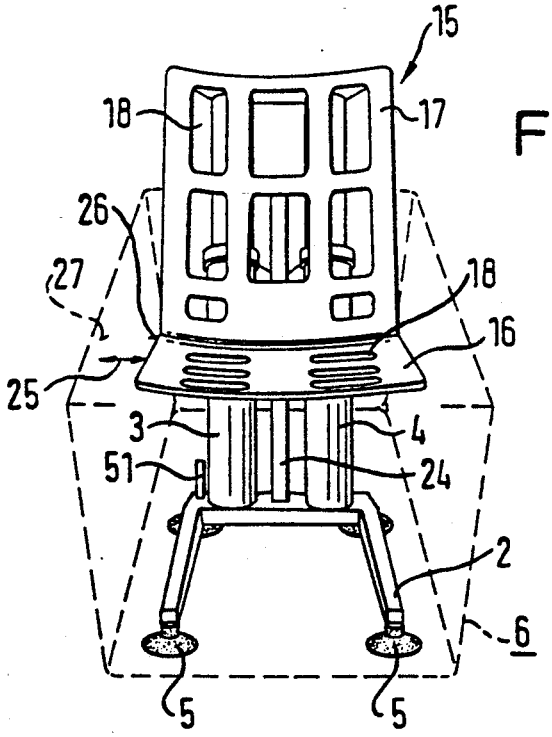
FIG. 2 is a front-elevational view of the same bathing aid as seen toward a seating surface in a half-raised state in a bathtub.

The bathing aid is shown again in FIG. 2 as being disposed in a bathtub 6 as seen in a view from the front looking onto the seating frame. One important problem in such bathing aids is a gap 25 between a side edge 26 of the seating surface 16 and a side wall 27 of the bathtub, which is diagrammatically illustrated in the drawing. When the seat 16 is re-lowered, the gap 25 decreases continuously, because of the generally obliquely inclined side wall 27 of the bathtub. If an arm or leg has gotten into this gap 25 and this gap is decreased continuously as the seating surface 16 is lowered, then that part of the body can be badly caught.

In order to prevent this, the following provisions are made according to the invention.

Figure 3:
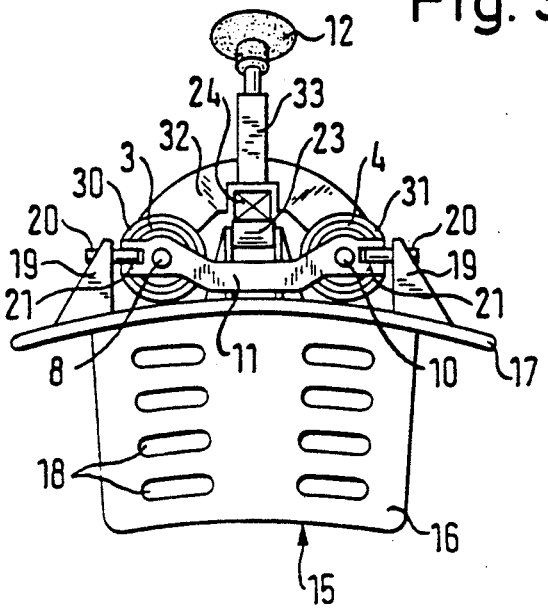
FIG. 3 is a top-plan view of the bathing aid.
Figure 4:
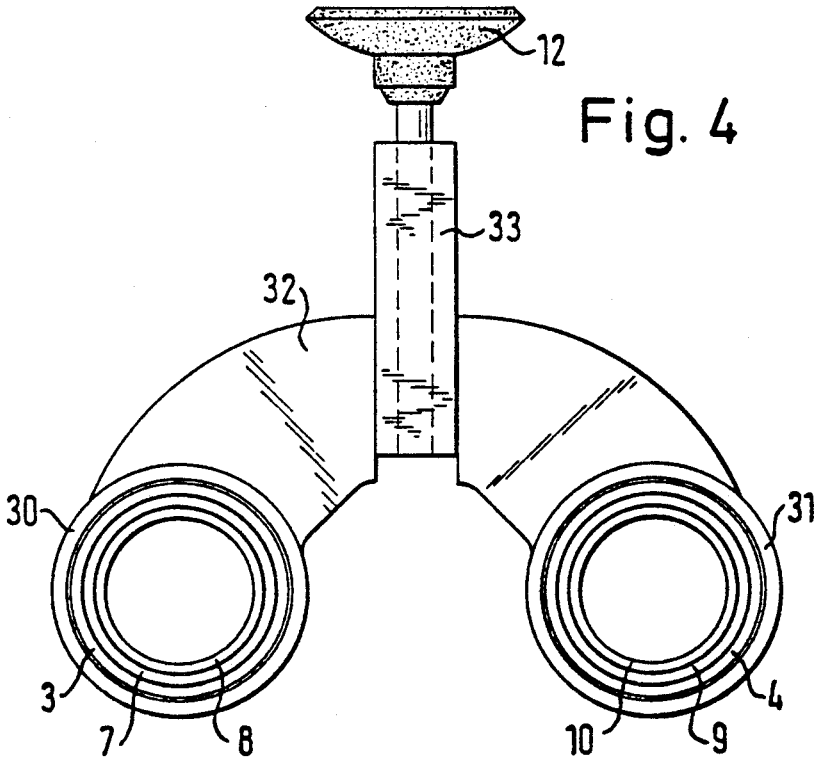
FIG. 4 is an enlarged, cross-sectional view of retaining means of outer hydraulic cylinders.

In FIG. 3, a view of the bathing aid as seen vertically from above, parallel to the backrest 17 is shown, namely in a mounted state, while in FIG. 4 an enlarged view of a cross section through the telescoping bars in the region just above the suction cup lock 12 is shown.

According to the invention, upper ends of the two telescoping cylinders or tubes 3 and 4, which correspond to FIG. 1, are in fact encompassed by two rings 30 and 31, that are rigidly joined together by a hoop 32 which may, for instance, have a semicircular shape. The rings 30 and 31 have a slightly larger inside diameter than the outside diameter of the hydraulic cylinders 3 and 4, so that the hydraulic cylinders 3 and 4 are guided in the rings 30 and 31 with a play of approximately 0.5 mm. The hoop 32 also has a rearwardly projecting strut 33, on the forward end of which the suction cup 12 is secured with an adjustable spacing.

As a result of this guidance with play of the hydraulic cylinders 3 and 4 in the rings 30 and 31 with their hoop 32, the entire base frame 1 can twist, if there is pressure exerted on the side edge 26 of the seating surface 16 by some body part caught in the gap, and the hydraulic cylinders 3 and 4 can twist slightly in the rings 30 and 31, so that the seat 16 deflects laterally, thus enlarging the gap and making it possible to pull out the body part that has been caught.

This provides optimal safety for the patient who is bathing.

FIG. 3 also very clearly shows the retention of the backrest 17 in the crossbar 11 mounted on the upper hydraulic cylinders 8 and 10, in which the cylinders struts 19 projecting rearward from the backrest 17 are suspended by the cross-pins 20 in the corresponding lateral recesses 21 in the crossbar 11. The lower guidance by means of the slide roller 23 on the guide rod 24 can also be seen clearly.

As FIG. 5 shows, this guide rod 24 is bent off parallel in the upper region in the direction toward the backrest 17. As a result, when the seating frame is raised in the upper region, the slide roller 23 and thus the seating surface 16 are pressed forward and their angle is adjusted slightly. That is, the seating surface 16 is then no longer exactly parallel to the bottom of the bathtub, as it was when it was lower, but rather it is inclined by a small angle, which improves the seating position and thus the safety.

The above-described slight twistability of the base frame 1 is also dictated by the structure of the intrinsically very securely adhering suction cups 5 and 12, one of which is again shown separately in cross section in FIG. 7. This suction cup 5 has a concavely curved lower surface 40 and a convexly curved upper surface 41, in the usual manner. A cylindrical extension 42 is provided centrally, and a screw bolt 43 can be vulcanized into it for locking purposes. This suction cup 5 has an approximately linear contact surface 45 at an outer rim 47 of the concavely curved lower surface 40 with which it rests on a plane 46. The contact surface 45 may also have a certain finite width on the plane 46, and when pressed down it forms an airtight closure between the lower surface 40 and the plane 46.

An essential feature for easy release of this suction cup 5 is that the rim 47 of the suction cup 5 protrudes radially outward past the contact surface 45 and is inclined relative to the plane 46 to be supported by an angle of less than 90°.

An angle of approximately 30° has proved to be particularly suitable.

This obliquely inclined outer rim 47 provides a favorable engagement surface that can easily be grasped from behind, compressed and pulled upward, so that the suction cup 5 can be released from the underlying surface without major exertion and without using additional aids.

As already noted, the hydraulic cylinders 3 and 4 as shown in FIG. 1 are connected to the cold water faucet of the bathtub through a hose 50, which communicates with the hydraulic cylinders 3 and 4 through a connection 51 on the bottom frame 2, a reversible multi-position valve 52 and a further line 53. In order to prevent the cold hydraulic fluid from mixing with the bathwater when the seat frame is lowered and the hydraulic fluid is drained out, a further line 54 is provided, which leads from the multi-position valve 52 directly into a secondary drain 55 for drainage out of the bathtub 6. A separate secondary drain is used for this purpose, as shown in cross section in FIG. 8. This secondary drain 55 includes an angled piece of rubber or plastic tubing 56 with two longitudinal bores 57 and 58 disposed at right angles to one another. The flexible hose 54 is connected to one end of the tube 56 through a swivel joint 59.

An annular extension 60, having an outside diameter which is smaller than the inside diameter of a diagrammatically shown bathtub drain 61, is provided on the other end of the piece of tubing 56, toward the drain. An outer surface 62 of this extension 60 is constructed in such a way that it converges toward the bottom in a slightly conical fashion. On the top of the extension 60, it changes into a radially projecting annular lip 63, having an outside diameter which is so large that the lip 63 covers the bathtub drain 61 in the adjoining annular region with certainty.

This lip 63 is advantageously shaped in such a way that it drops away toward the outside in a slightly conical fashion. As a result, and because of its flexibility, after the shaped part 55 has been inserted into the bathtub drain 61, the lip rests on the lateral rim of this drain and sticks there virtually firmly by suction, so that the contents of the bathtub itself cannot also drain out.

Advantageously, this separate bathtub drain 55 is first inserted into the drain opening 61 of the bathtub 6, and the bathwater is then run in. This secondary drain then simultaneously acts like the actual tub closure plug. Once the bathtub has been filled and the bathing aid has been lowered, the cold hydraulic fluid is then passed directly into the drain through the piece of tubing 56, and from there it can run out. Once bathing is finished, this secondary bathtub drain can be pulled out, so that the bathwater itself can drain out as well.

The overall result is accordingly a bathing aid for frail or handicapped persons, which not only affords simplicity and ease of operation but also optimal safety, and largely precludes harm even in emergencies.

I claim:

1. A bathing aid, comprising a basic frame to be placed on the bottom surface of a bathtub, said basic frame having a U-shaped bottom frame with legs and a rear crossbar between the legs, two outer hydraulic cylinders protruding obliquely upward from said rear crossbar and having upper ends, inner hydraulic cylinders telescopically received in said outer hydraulic cylinders for upward and downward movement, said inner cylinders having upper ends which at all times extend above the outer cylinder, a seat frame having a backrest with an upper edge being pivotably connected to said upper ends of said inner hydraulic cylinders, a reversible multi-position valve for connecting said hydraulic cylinders to a cold-water source of the bathtub to provide for hydraulic fluid for raising and lowering said seat frame in the bathtub, two cylindrical rings, one of which encompasses said upper end of each of said outer hydraulic cylinders with play between said rings and said outer hydraulic cylinders, a hoop joining said cylindrical rings to one another, said hoop having one end of a strut projecting rearwardly therefrom, a suction cup mounted on the other end of said strut for securing said cylindrical rings to an end wall of the bathtub, whereby said play between said rings and said outer cylinders will allow a limited lateral movement of said seat frame while within the confines of said tub.

2. A bathing aid, comprising a basic frame having a bottom frame to be placed onto the bottom surface of a bathtub, two outer hydraulic cylinders protruding obliquely upward from said bottom frame and having upper ends, inner hydraulic cylinders telescopically received in said outer hydraulic cylinders for upward and downward movement, said inner cylinders having upper ends at all times extending above the outer cylinders, a seat frame having a backrest, said seat frame being pivotably connected to said upper ends of said inner hydraulic cylinders, a valve for connecting said hydraulic cylinders to a water source to provide hydraulic fluid for raising and lowering said seat frame in the bathtub, two cylindrical rings, one of which encompasses said upper end of each of said outer hydraulic cylinders with play between said rings, and said outer hydraulic cylinders, a hoop joining said cylindrical rings to one another, said hoop having one end of a strut projecting rearwardly therefrom, a suction cup mounted on the other end of said strut for securing said cylindrical rings to an end wall of the bathtub, whereby said play between said rings and said outer cylinders will allow a limited lateral movement of said seat frame while within the confines of said tub.

3. The bathing aid according to claim 2, wherein said seat frame includes a bowl and a seating surface being cast in one piece with said backrest and having apertures formed therein, said backrest being inclined to match said obliquely upward protrusion of said outer hydraulic cylinders, two vertical struts protruding from said upper edge of said backrest, and cross-pins inserted in said struts, and including a crossbar joining said upper ends of said inner hydraulic cylinders, said crossbar having lateral grooves formed therein in which said cross-pins are pivotably suspended.

4. The bathing aid according to claim 3, including a guide rod disposed between said hydraulic cylinders, said guide rod having an upper region being bent parallel in a direction toward the backrest, and a rearwardly projecting slide roller disposed centrally on a bottom end of said backrest and sliding on said guide rod.

5. The bathing aid according to claim 2, including. concavely curved, circular platform-shaped suction cups for locking said bottom plate and said hoop holding said hydraulic cylinders against a wall of the bathtub, said suction cups having a contact surface and a rim extending radially outward past said contact surface and being inclined relative to a supporting plane by an angle of less than 90°.

6. The bathing aid according to claim 2, including a shaped part to be inserted into a bathtub drain for draining hydraulic fluid, said shaped part including an angled tubular piece with two sides, a flexible drain line connected to one of said sides of said tubular piece from said hydraulic cylinders, and an annular extension on the other of said sides of said tubular piece having a smaller outside diameter than the inside diameter of the bathtub drain for placement in the bathtub drain, said extension having a top changing into a radially projecting annular lip with a laterally protruding rim being wide enough to completely cover the bathtub drain.

7. The bathing aid according to claim 2, including a bacteria-repellent lacquer coating all parts coming into contact with bathwater.

8. The bathing aid according to claim 2, including a bacteria-repellent plastic coating all parts coming into contact with bathwater.

9. The bathing aid according to claim 2, wherein the play between said rings and said outer hydraulic cylinders amounts to approximately 0.5 mm.

* * * * *